US005669047A

United States Patent [19]

Okuda et al.

[11] Patent Number: 5,669,047

[45] Date of Patent: Sep. 16, 1997

[54] CHARGING MEMBER, ELECTROPHOTOGRAPHIC APPARATUS AND CHARGING METHOD USING THE SAME

[75] Inventors: Masami Okuda; Hisami Tanaka, both of Yokohama; Junichi Kishi; Hiroyuki Ohmori, both of Tokyo; Takashi Koyama, Yokohama; Masafumi Hisamura, Toride, all of Japan

[73] Assignee: Canon Kabushiki Kaisha, Tokyo, Japan

[21] Appl. No.: 465,577

[22] Filed: Jun. 5, 1995

Related U.S. Application Data

[63] Continuation of Ser. No. 161,443, Dec. 6, 1993, abandoned, which is a continuation of Ser. No. 487,377, Mar. 2, 1990, abandoned.

[30] Foreign Application Priority Data

Mar. 3, 1989 [JP] Japan ..... 1-051623

[51] Int. Cl.[6] ..... G03G 15/02; G03G 13/00; H01T 23/00

[52] U.S. Cl. ..... 399/174; 399/176; 361/225; 361/230; 428/330; 428/412; 428/423.1; 428/906; 430/31; 430/902

[58] Field of Search ..... 430/902, 31; 355/219; 361/225, 230; 428/330, 423.1, 412; 399/174, 176

[56] References Cited

U.S. PATENT DOCUMENTS

| | | | |
|---|---|---|---|
| 2,980,834 | 4/1961 | Tregay et al. | 361/225 |
| 3,670,203 | 6/1972 | Whitmore et al. | 361/225 |
| 3,671,806 | 6/1972 | Whitmore et al. | 317/2 R |
| 3,935,517 | 1/1976 | O'Brien | 317/262 A |
| 4,062,812 | 12/1977 | Safford et al. | 252/500 |
| 4,272,616 | 6/1981 | Kishimoto | 430/528 |
| 4,309,737 | 1/1982 | Tolmie, Jr. | 361/225 |
| 4,340,659 | 7/1982 | Whalen-Shaw et al. | 430/64 |
| 4,349,606 | 9/1982 | Kishimoto et al. | 428/423.1 |
| 4,542,095 | 9/1985 | Steklenski et al. | 430/527 |
| 4,582,781 | 4/1986 | Chen et al. | 430/527 |
| 4,617,245 | 10/1986 | Tanaka et al. | 430/58 |
| 5,089,851 | 2/1992 | Tanaka et al. | 430/902 X |
| 5,110,669 | 5/1992 | Knobel et al. | 428/412 |

FOREIGN PATENT DOCUMENTS

| | | |
|---|---|---|
| 272072 | 6/1988 | European Pat. Off. . |
| 51-013661 | 5/1976 | Japan . |
| 56-104351 | 8/1981 | Japan . |
| 57-178267 | 11/1982 | Japan . |
| 58-040566 | 3/1983 | Japan . |
| 58-139156 | 8/1983 | Japan . |
| 58-150975 | 9/1983 | Japan . |

OTHER PUBLICATIONS

Patent Abstracts of Japan, vol. 12, No. 456 (P-793) [3033], Nov. 30, 1988-JPA 63-178249.

*Primary Examiner*—George F. Lesmes
*Assistant Examiner*—Bernard P. Codd
*Attorney, Agent, or Firm*—Fitzpatrick, Cella, Harper & Scinto

[57] ABSTRACT

A charging member for electrophotography comprising a surface layer, wherein the surface layer comprises a resin and an alkali metal salt contained therein.

8 Claims, 1 Drawing Sheet

CHARGING MEMBER, ELECTROPHOTOGRAPHIC APPARATUS AND CHARGING METHOD USING THE SAME

This application is a continuation of application Ser. No. 08/161,443, filed Dec. 6, 1993, now abandoned, which, in turn, is a continuation of application Ser. No. 07/487,377 filed Mar. 2, 1990, now abandoned.

FIELD OF THE INVENTION AND RELATED ART

The present invention relates to a charging member for electrophotography, particularly to a charging member for charging an electrophotographic photosensitive member. The present invention also relates to an electrophotographic apparatus and a charging method using such a charging member.

In the conventional charging step included in electrophotographic processes using an electrophotographic member, in most cases, a high voltage (DC voltage of about 5–8 KV) is applied to a metal wire to generate a corona, which is used for the charging. In this method, however, a large amount of a corona discharge product such as ozone and NOx is generated along with the corona charging. Such a corona discharge product deteriorates the photosensitive member surface to cause image quality deterioration such as image blur (or image fading). Further, because the contamination on the metal wire affects the image quality undersired white droppings (or white dropout) or black streaks occur in the resultant copied image.

Moreover, the proportion of the current directed to the photosensitive member is generally 5–30% of the consumed current, and most thereof flows to a shield plate disposed around the metal wire. As a result, the conventional corona charging method has provided low electric power efficiency.

Therefore, in order to solve the above-mentioned problems, there has been investigated a contact charging method wherein a charging member is caused to directly contact a photosensitive member to charge the photosensitive member, as disclosed in Japanese Laid-Open Patent Application (JP-A, KOKAI) Nos. 178267/1982, 104351/1981, 40566/1983, 139156/1983, 150975/1983, etc.

However, in practice, even when a photo-sensitive member is charged by using the above-mentioned contact charging method, the photosensitive member surface is not evenly charged to cause charging unevenness in the form of spots. Accordingly, e.g., in a reversal development system, when the photosensitive member having the charging unevenness in the form of spots is subjected to an electrophotographic process including an image exposure step, et seq., the output image includes black spot-like images (black spots) corresponding to the above-mentioned spot-like charging unevenness. On the other hand, a normal development system only provides an output image including a white spot-like image (white spots). As a result, it has been difficult to obtain a high-quality image.

Further, in spite of the above-mentioned many proposals, an electrophotographic apparatus utilizing the direct (or contact) charging method has never been put on the market up to the present. The reason for this is, e.g., that the conventional direct charging method cannot charge a photosensitive member uniformly but causes a dielectric breakdown of the photosensitive member due to the direct application of voltage. When the dielectric breakdown occurs to provides one breakdown point, e.g., in a cylindrical photosensitive member, charges provided on the whole contact portion along the axis direction thereof flow into the breakdown point to cause charging failure.

SUMMARY OF THE INVENTION

A principal object of the present invention is to solve the above-mentioned problem and to provide a charging member for electrophotography which is capable of stably providing high-quality images without causing spot-like fog due to charging unevenness or image defect due to dielectric breakdown in a photosensitive member.

According to the present invention, there is provided a charging member for electrophotography comprising a surface layer, wherein the surface layer comprises a resin and an alkali metal salt contained therein.

The present invention also provides an electrophotographic apparatus comprising an electrophotographic photosensitive member and a charging member disposed in contact with the photosensitive member, wherein the charging member comprises a surface layer comprising a resin and an alkali metal salt contained therein.

The present invention further provides a contact charging method, comprising:

providing a charging member comprising a surface layer which comprises a resin and an alkali metal salt contained therein;

providing an electrophotographic photosensitive member disposed in contact with the charging member; and applying a pulsation voltage comprising a superposition of a DC voltage and an AC voltage to the charging member, thereby charging the photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
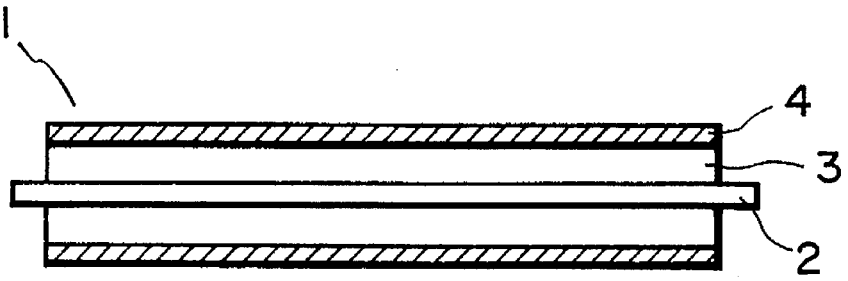
FIG. 1 is a schematic sectional view showing an embodiment of the charging member according to the present invention.

In a preferred embodiment of the present invention, the charging member for electrophotography has a multi-layer structure comprising a base layer, and a surface layer disposed thereon. The surface layer of the charging member to be disposed in contact with an electrophotographic photosensitive member comprises a resin and an alkali (or alkaline) metal salt contained therein.

Examples of the resin constituting the surface layer in combination with the alkali metal salt may include: thermoplastic resins such as polyvinyl alcohol, polyvinyl alkyl ether, poly-N-vinylimidazole, alkyl cellulose, nitrocellulose, polyacrylic acid ester, casein, polyester, polyamide, polyethylene oxide, polypropylene oxide, polyamino acid ester, polyvinyl acetate, polycarbonate, polyvinyl pyrrolidone, chloroprene rubber, nitrile rubber, polymethacrylic acid ester, polypeptide, polymaleic anhydride, polyacrylamide, polyvinyl formal, polyvinylpyridine, polyethylene glycol, polypropylene glycol, polyvinyl butyral, chlorosulfonated polyethylene, and thermoplastic polyurethane; thermosetting resins such as thermosetting polyurethane, phenolic resin, and epoxy resin; etc.

Among these, thermoplastic resins of nitrocellulose, polyvinyl acetate, and polycarbonate, and thermosetting polyurethane are preferred in view of the durability of the charging member.

Examples of the alkali metal salt may include: salts of lithium, sodium and potassium with $ClO_4$, SCN, $BF_4$, $NO_3$, $CO_3$, $CS_3$, $WO_4$, $BO_2$, $IO_4$, $SO_4$, $S_2O_3$, $PO_3$, $MoO_4$, $O_3SCH_3$, $O_3SCF_3$, $SiF_6$, halogen atoms, etc. Specific examples of such a salt may include: $LiClO_4$, $LiSCN{\cdot}2H_2O$, KSCN, $LiBF_4$, $NaNO_3$, $Na_2CO_3{\cdot}7H_2O$, $K_2WO_4$, $K_2CS_3$, $NaBO_2$, $LiIO_4$, $LiSO_4$, $NaS_2O_3{\cdot}5H_2O$, $KPO_3$, $Na_2MoO_4$, $LiO_3SCH_3$, $LiO_3SCF_3$, $K_2SiF_6$, LiCl, LiBr, NaBr, LiI, $NaI{\cdot}2H_2O$, KI, etc. The alkali metal salts may be used singly or as a combination of two or more species.

The above-mentioned alkali metal salt may preferably be added to a resin in an amount of 0.5 to 40 wt. parts per 100 wt. parts of the resin. Such an addition amount may be determined by the volume resistivity (or volume resistance), which is one of the characteristics required for the surface layer of a charging member.

The alkali metal salts may appropriately be combined with the resin depending on the correlation therebetween. In general, it is preferred that the alkali metal salt is dissolved in a solvent together with a resin as desired. The resultant coating liquid is used for forming the surface layer taking into account control of the addition amount and stability in the physical property of the resultant coating film with the elapse of time.

The alkali metal salt can also be added to the surface layer by doping after the formation of the film. The surface layer may be used, in some cases, in a state where at least a portion of the alkali metal salt is deposited in the surface layer.

The surface layer may preferably have a volume resistivity which is higher than that of the base layer contacting the surface layer as described hereinafter. More specifically, the volume resistivity of the surface layer may preferably be $10^6$ to $10^{12}$ ohm.cm, more preferably $10^7$ to $10^{11}$ ohm.cm. The ratio of (volume resistivity of the surface layer)/(volume resistivity of the base layer) may preferably be 10 or larger, more preferably $10^2$ or larger. The surface layer may preferably have a film thickness of 5–500 microns, more preferably 20–200 microns.

The material constituting the base layer may include: metals such as aluminum, iron and copper; electroconductive polymer materials such as polyacetylene, polypyrrole and polythiophene; rubbers or resins supplied with electroconductivity, e.g., by dispersing therein electroconductive particles such as carbon and metal; and resins or rubbers such as polycarbonate and polyester having a surface laminated or coated with a metal or another conductive material. The base layer may comprise a single layer or two or more layers. The volume resistivity of the base layer may preferably be $10^0$–$10^{11}$ ohm.cm, particularly $10^2$–$10^{10}$ ohm.cm. The film thickness of the surface layer may preferably be 10 microns to 20 mm, more preferably 20 microns to 10 mm.

When a conventional resin such as polyurethane and nylon is used in the surface layer, the charging is not conducted unless a high voltage of 4 KV or higher is applied, as described in Japanese Patent Publication (JP-B, KOKOKU) No. 13661/1976, whereby the charging efficiency is low. Further, when such a high voltage is used, a large amount of a discharge product such as ozone and NOx is produced, thereby deteriorating the photosensitive member to cause image blur, image flow, etc. On the contrary, when a resin containing an alkali metal salt is used in the surface layer as in the present invention, good charging can be effected to remarkably reduce the resultant image defect.

On the other hand, in the case of a conventional charging member of which surface portion comprises an electroconductive material, e.g., rubber or insulating resin imparted with electroconductivity by dispersing therein metal, electroconductive polymer, carbon, etc., or an insulating material of which surface is laminated or coated with an electroconductive material, when discharge dielectric breakdown occurs in a photosensitive member, an excessive current is passed from such a charging member to one breakdown point (pin-hole), whereby the voltage applied to the charging member is reduced. As a result, charging failure occurs in the whole contact area between the photosensitive member and the charging member, and a white streak appears in a normal development system and a black streak appears in a reversal development system.

However, in the present invention, since a resin containing an alkali metal salt is used in the surface layer, the volume resistivity thereof is controlled and the voltage drop due to an excessive current is suppressed even when a defect such as dielectric breakdown occurs in an electrophotographic photosensitive member.

It is preferred that the electric resistance of a charging member is not substantially affected by a change in external environmental conditions, particularly, a change in humidity of the atmosphere. When the surface layer of a charging member consists of a single resin as in the prior art, the volume resistivity can be increased by a factor of three figures, e.g., under a low temperature—low humidity (15° C., 10%RH) condition.

On the other hand, since the electrophotographic charging member according to the present invention comprises a surface layer comprising a resin and an alkali metal salt contained therein, it provides little variation in the volume resistivity and may stably provide a charging ability even under a low temperature—low humidity condition.

The form of shape of the charging member according to the present invention may be any of roller, brush, blade, belt, etc. The form of the charging member can appropriately be selected corresponding to the specifications and form of an electrophotographic apparatus using it. Among these, a roller form is preferred in view of uniformity in charging.

FIG. 1 shows a schematic sectional view of an embodiment of the electrophotographic charging member 1 according to the present invention having a roller form. In this embodiment, the charging member 1 basically comprises an electroconductive substrate 2, and a base layer 3 and a surface layer 4 disposed in this order on the substrate 2.

The electroconductive substrate 2 constituting the central shaft of the charging member 1 in this embodiment may comprise an electroconductive resin or a metal such as iron, copper, stainless steel, aluminum, and aluminum alloy. The substrate 2 may have a cylindrical shape, plate-like shape, etc. Another layer such as adhesive layer may further be disposed between the electroconductive substrate 2 and the base layer 3, and/or between the base layer 3 and the surface layer 4, as desired.

The charging member 1 may be prepared, e.g., by successively forming a base layer 3 and a surface layer 4 on an electroconductive substrate 2 by molding or coating; or by forming a base layer 3 and a surface layer 4 and then introducing or inserting an electroconductive substrate 2 into the center of the resultant product.

Figure 2:
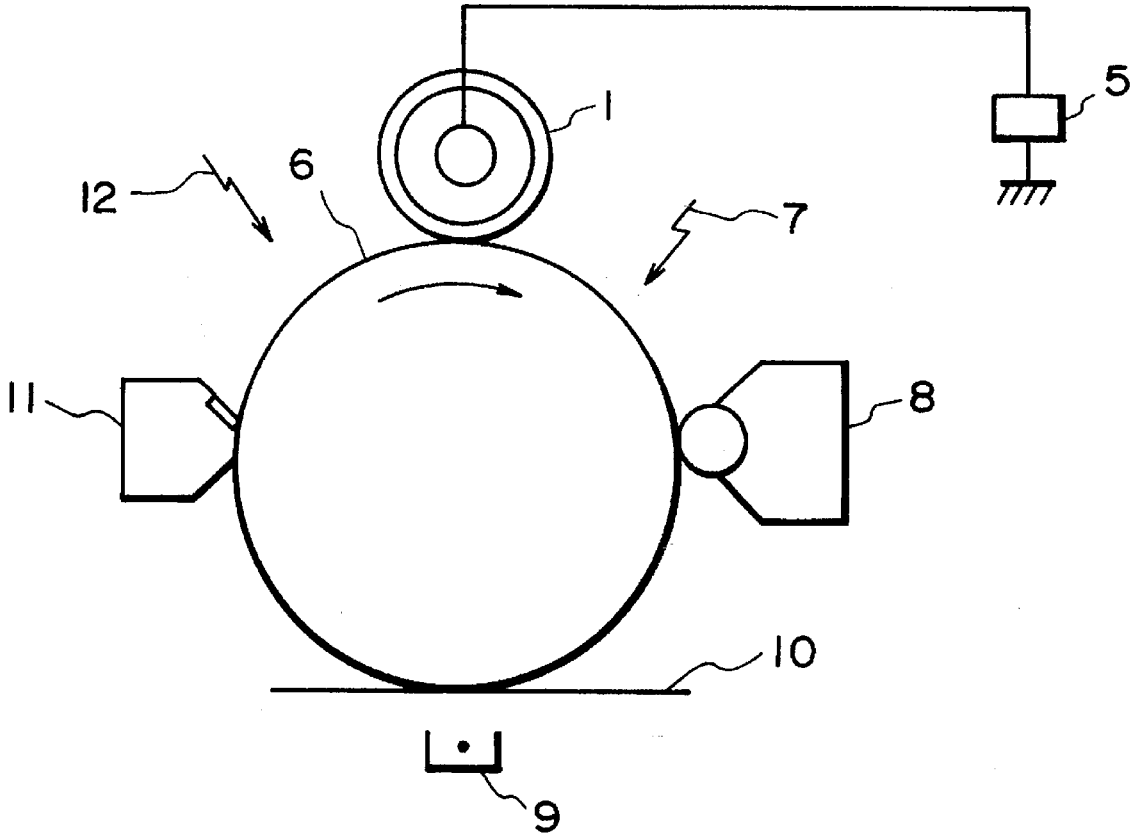
FIG. 2 is a schematic sectional view showing an electrophotographic apparatus using the charging member according to the present invention.

The charging member 1 according to the present invention may be used in an electrophotographic apparatus as shown in FIG. 2 so as to charge an electrophotographic photosensitive member 6.

Referring to FIG. 2, the electrophotographic apparatus comprises: a cylindrical photosensitive member 6, and around the peripheral surface of the photosensitive member 6, a charging member 1 as a primary charger according to the present invention, an image exposure means (not shown) for providing a light beam 7 to form a latent image on the photosensitive member 6, a developing device 8 for developing the latent image with a toner or developer (not shown) to form a toner image, a transfer charger 9 for transferring the toner image from the photosensitive member 6 onto a transfer-receiving material (or transfer material) 10 such as paper, a cleaner 11 for removing a residual toner, and a pre-exposure means (not shown) for providing light 12.

In operation, a prescribed voltage is externally applied to the charging member 1 disposed in contact with the photosensitive member 6 by means of an external power supply 5 connected to the charging member 1, thereby to charge the photosensitive member 6.

Further, image formation may be effected by means of such an electrophotographic apparatus using the charging member 1 in the following manner.

Referring to FIG. 2, a prescribed voltage is externally applied to the charging member 1 disposed in contact with the photosensitive member 6 by means of an external power supply 5 connected to the charging member 1, thereby to charge the photosensitive member 6, and the photosensitive member 6 is imagewise exposed to light 7 corresponding to an original image by the image exposure means, thereby forming an electrostatic latent image on the photosensitive member 6. Then, the electrostatic latent image formed on the photosensitive member 6 is developed or visualized by attaching the toner or developer contained in the developing device 8 to form a toner image on the photosensitive member 6. The toner image is then transferred to the transfer-receiving material 10 such as paper by means of the transfer charger 9 to form a toner image thereon. The residual toner which remains on the photosensitive member 6 without transferring to the transfer-receiving material 10 at the time of the transfer operation is recovered by means of the cleaner 11.

Thus, the copied image is formed by such an electrophotographic process. In a case where residual charges remain on the photosensitive member 6, the photosensitive member 6 may preferably be exposed to light 12 by the pre-exposure means to remove the residual charge, prior to the above-mentioned primary charging.

The light source for providing light 7 for image exposure may be a halogen lamp, a fluorescent lamp, a laser, an LED, etc. The development system may be either a normal development system or a reversal development system.

A plurality of elements or components of an electrophotographic apparatus such as the above-mentioned photosensitive member, developing means and cleaning means may be unitedly assembled into a device unit, and the device unit may be detachably disposed in the apparatus body. For example, a photosensitive member and a cleaning means may be unitedly assembled in a device unit, and such a device unit is detachably disposed in the apparatus body by the medium of a guiding means such as rail of the apparatus body. In such an embodiment, a charger and/or a developing means may further be assembled in the above-mentioned device unit.

The arrangement of the charging member 1 should not particularly be restricted. More specifically, such arrangement may include: one wherein the charging member 1 is fixed; or one wherein the charging member 1 is moved or rotated in the same direction as, or in the counter direction to, that of the movement of the photosensitive member 6.

The charging member according to the present invention may be used not only for the primary charging step but also for the transfer charging step or charge-removing (or discharge) step requiring a charging operation.

In the present invention, the voltage applied to the charging member 1 may preferably be one in the form of a pulsation (or pulsating current) voltage obtained by superposing an AC voltage on a DC voltage. In such case, there may preferably be used a pulsation voltage obtained by superposing a DC voltage of ±200 V to ±1500 V on an AC voltage having a peak-to-peak voltage of 2000 V or below. The voltage applied to the charging member 1 may also be a DC voltage or an AC voltage.

The application method for such a voltage, while also varying depending on the specifications of respective electrophotographic apparatus, may include: one wherein a desired voltage is instantaneously applied; one wherein the applied voltage is gradually or stepwise raised in order to protect a photosensitive member; or one wherein a DC voltage and an AC voltage are applied in a sequence of from DC voltage to AC voltage, or of from. AC voltage to DC voltage, when a superposition of a DC voltage and an AC voltage is applied to the charging member.

The member to be charged by means of the charging member according to the present invention may be an electrophotographic photosensitive member. Such an electrophotographic photosensitive member may for example be constituted in the following manner.

The photosensitive member for electrophotography may comprise an electroconductive substrate and a photosensitive layer disposed thereon. The electroconductive substrate may be a substrate which per se has an electroconductivity such as that of aluminum, aluminum alloy, stainless steel and nickel; alternatively, a substrate of a plastic coated with, e.g., a vapor-deposited layer of aluminum, aluminum alloy, or indium oxide-tin oxide alloy; substrate coated with a mixture of electroconductive powder such as tin oxide or carbon black and an appropriate binder; or a plastic substrate having an electroconductive binder layer.

Between the electroconductive substrate and the photosensitive layer, there may be formed a primer or undercoat layer having a barrier function and an adhesive function. The primer layer may be formed of, e.g., casein, polyvinyl alcohol, nitrocellulose, ethylene-acrylic acid copolymer, polyamide (nylon 6, nylon 66, nylon 610, copolymer nylon, etc.), polyurethane, gelatin, or aluminum oxide. The thickness of the primer layer should preferably be 5 microns or below, particularly 0.5 to 3 microns. The primer layer may preferably have a volume resistivity of $10^7$ ohm.cm or above, in order to fully perform its function.

The photosensitive layer may for example be formed by applying an organic or inorganic photoconductive material together with a binder as desired, or by vacuum vapor deposition such as vacuum evaporation. In the present invention, there may preferably be used an organic-type photosensitive layer having a laminate structure comprising function-separated charge generation layer and charge transport layer. The charge transport layer may for example be disposed on the charge generation layer.

The charge generation layer may comprise a charge-generating substance such as azo pigments, phthalocyanine pigments, quinone pigments and perylene pigments. The charge generation layer may be formed by vapor-depositing such a charge-generating substance, or by applying a coating material comprising such a charge-generating substance together with an appropriate binder as desired, while the binder is omissible.

The charge generation layer may generally have a thickness of 0.01–15 microns, preferably 0.05–2 microns.

The charge transport layer may comprise a resin having a film-formability and a charge-transporting substance dissolved or dispersed therein. The charge-transporting substance used in the present invention may include hydrazone compounds, styryl compounds, oxazole compounds, and triarylamtne compounds. The charge transport layer may generally have a thickness of 5–50 microns, preferably 10–30 microns.

Further, a protective layer may further be provided on the photosensitive layer, as desired, so as to prevent the deterioration due to ultraviolet rays.

The charging member for electrophotography according to the present invention may be used not only for ordinary copying machines but also in the fields related to electrophotography such as laser printers, CRT printers and electrophotographic plate-making system.

The present invention will be explained in more detail with reference to examples.

EXAMPLES 1–5

First, a charging member was prepared in the following manner.

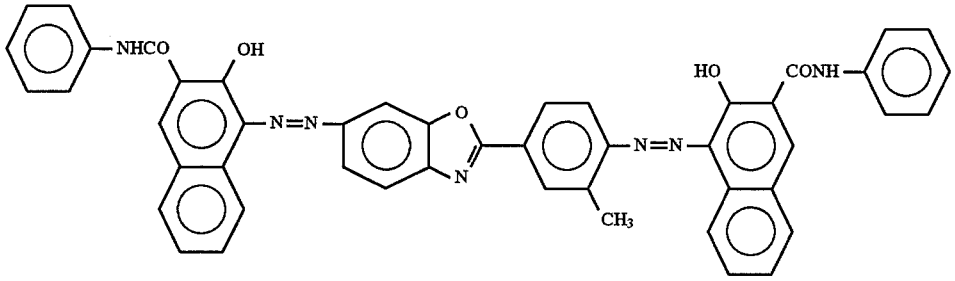

100 wt. parts of chloroprene rubber (trade name: Denka-Chloroprene, manufactured, by Denki Kagaku Kogyo, number-average molecular weight (Mn)=200,000) and 5 wt. parts of electroconductive carbon (trade name: Conductex 900, manufactured by Columbian Chemicals Co.) were melt-kneaded and molded into a roller shape having a diameter of 20 mm and a length of 230 mm wherein a stainless steel shaft having a diameter of 6 mm and a length of 250 mm was disposed in the center portion, thereby forming a base layer of a roller-form charging member. The volume resistivity of the base layer was $3\times10^4$ ohm. cm when measured at a temperature of 22° C. and a humidity of 60%.

Then, 100 wt. parts of a hexamethylene diisocyanate blocked with methyl ethyl ketone oxime (trade name: Coronate 2507, manufactured by Nihon Polyurethane Kogyo K.K.) and 50 wt. parts of a polyester polyol (trade name: Nippollan 800, manufactured by Nihon Polyurethane Kogyo K.K.) were dissolved in a mixture solvent comprising 15 wt. parts of methyl cellosolve and 35 wt. parts of methyl ethyl ketone, thereby to prepare a coating solution. 20 wt. parts of each of $LiClO_4$, $LiBF_4$, $NaBF_4$, LiSCN, and KSCN was added to 200 wt. parts of the coating solution, respectively, to thereby prepare fine species of coating liquid for the surface layer. Each of the thus obtained five species of coating liquids was applied onto the above-mentioned base layer by dip coating and dried at 140° C. for 30 min. to form a surface layer of the charging member having a thickness of 200 microns (after drying), whereby five species of charging members were prepared (Examples 1–5). Further, five species of surface layers were respectively formed on an aluminum sheet in the same manner as described above, and their volume resistivities were measured.

Separately, an electrophotographic photosensitive member was prepared in the following manner.

There was provided an electroconductive substrate of an aluminum cylinder having a wall thickness of 0.5 mm, a diameter of 60 mm and a length of 260 mm. A coating liquid obtained by dissolving 4 wt. parts of a copolymer nylon (trade name: Amilan CM-8000, manufactured by Toray K.K.) and 4 wt. parts of a nylon-8 (trade name: Luckamide 5003, manufactured by Dainihon Ink K.K.) in 50 wt. parts of methanol and 50 wt. parts of n-butanol was applied onto the electroconductive substrate by dip coating to form a 0.6 micron-thick polyamide undercoat layer.

Next, 10 wt. parts of a disazo pigment represented by the following structural formula as a charge-generating substance, and 10 wt. parts of a polyvinyl butyral resin (S-LEC BM2, manufactured by Sekisui Kagaku K.K.) as a binder resin were dispersed in 120 wt. parts of cyclohexanone by means of a sand mill for 10 hours.

To the resultant dispersion, 30 wt. parts of methyl ethyl ketone was added, and then the dispersion was applied onto the undercoat layer to form a 0.15 micron-thick charge generation layer.

Then, 10 wt. parts of a hydrazone compound represented by the following structural formula as a charge-transporting substance, and 10 wt. parts of a polycarbonate-Z resin (weight-average molecular weight of 20,000, manufactured by Mitsubishi Gas Kagaku K.K.) as a binder resin were dissolved in 80 wt. parts of monochlorobenzene.

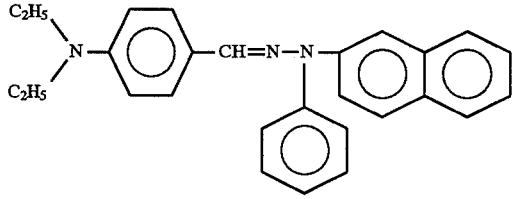

The resultant coating liquid was applied onto the above-mentioned charge generation layer to form a 16 micron-thick charge transport layer, whereby a photosensitive member (No. 1) was prepared.

The thus prepared photosensitive member No. 1 was assembled in an electrophotographic copying machine using a normal development system and having a system arrangement as shown in FIG. 2 (trade name: PC-20, manufactured by Canon K.K.) which had been so modified that each of the above-mentioned primary charging rollers was assembled therein instead of the primary corona charger as shown in FIG. 2.

In such an apparatus, a superposition of a DC voltage of −750 V and an AC voltage having a peak-to-peak voltage of 1500 V was used for the primary charging, whereby a dark part potential, and a light part potential were measured. In addition, a pin hole having a diameter of 1 mm was made in the photosensitive member, and the resultant image was evaluated.

More specifically, the above-mentioned items were measured in the following manner at 22° C. and 60%RH.

Dark Part Potential and Light Part Potential

After 1 sec. from the primary charging, these potentials were measured by means of Treck electrometer (manufactured by Treck Co., United Kingdom). In the case of the light part potential, the photosensitive member was exposed to light of 5 lux.sec. after 0.3 sec. from the primary charging.

Image Defect and Leak

Copied images were visually observed.

The results are shown in Table 1 appearing hereinafter.

Further, the volume resistivity of each charging member, potential characteristics and resultant images obtained by assembling each charging member in a copying machine using a normal development system were evaluated in the same manner as described above except that these items were evaluated under a low temperature—low humidity condition (temperature: 15° C.; humidity: 10%). The results are shown in Table 2 appearing hereinafter.

Comparative Example 1

A roller-type member obtained in Example 1 which comprised the stainless steel shaft and the base layer disposed thereon was as such assembled in a copying machine instead of the primary corona charger, and evaluations were conducted in the same manner as in Example 1.

The results are shown in Tables 1 and 2 appearing hereinafter.

Comparative Example 2

A base layer for charging member was formed on a stainless steel shaft in the same manner as in Example 1.

Then, a coating liquid obtained by dissolving 10 wt. parts of nylon-6 in 90 wt. parts of dimethylformamide was applied onto the base layer by dip coating to form thereon a surface layer having a thickness of 200 microns (after drying), whereby a charging member was prepared.

The thus obtained charging member was evaluated in the same manner as in Example 1. The results are shown in Tables 1 and 2 appearing hereinafter.

Comparative Example 3

A base layer for charging member was formed on a stainless steel shaft in the same manner as in Example 1.

Then, a coating liquid obtained by dissolving 100 wt. parts of a hexamethylene diisocyanate and 50 wt. parts of a polyester polyol in a mixture solvent comprising 15 wt. parts of methyl cellosolve and 35 wt. parts of methyl ethyl ketone was applied onto the base layer by dip coating to form thereon a surface layer having a thickness of 200 microns (after drying), whereby a charging member was prepared.

The thus obtained charging member was evaluated in the same manner as in Example 1. The results are shown in Tables 1 and 2 appearing hereinafter.

TABLE 1

| Example | Alkali metal salt | Material for surface layer | Volume resistivity of surface layer material (ohm · cm) | Dark part potential (V) | Light part potential (V) | Image density | Image defect | Leak due to pin-hole |
|---|---|---|---|---|---|---|---|---|
| Ex. 1 | $LiClO_4$ | Polyurethane | $7 \times 10^6$ | −700 | −110 | Normal | None | None |
| 2 | $LiBF_4$ | Polyurethane | $6 \times 10^7$ | −700 | −120 | Normal | None | None |
| 3 | $NaBF_4$ | Polyurethane | $7 \times 10^9$ | −695 | −110 | Normal | None | None |
| 4 | LiSCN | Polyurethane | $5 \times 10^7$ | −700 | −105 | Normal | None | None |
| 5 | KSCN | Polyurethane | $9 \times 10^{10}$ | −680 | −120 | Normal | None | None |
| Comp. Ex. 1 | — | *1 | $3 \times 10^4$ | −700 | −120 | Normal | *2 | *3 |
| 2 | — | Nylon-6 | $1 \times 10^{13}$ | −410 | −50 | Low | *2 | None |
| 3 | — | Polyurethane | $1 \times 10^{14}$ | −350 | −45 | Low | *2 | None |

*1: Chloroprene rubber containing dispersed therein.
*2: White spots were observed.
*3: White dropouts in the form of lateral streaks occurred.

TABLE 2

| Example | Volume resistivity of surface layer material (ohm · cm) | Dark part potential (V) | Light part potential (V) | Image density | Image defect | Leak due to pin-hole |
|---|---|---|---|---|---|---|
| Ex. 1 | $2 \times 10^8$ | −700 | −130 | Normal | None | None |
| Ex. 2 | $8 \times 10^{10}$ | −700 | −135 | Normal | None | None |
| Ex. 3 | $9 \times 10^{11}$ | −700 | −125 | Normal | None | None |
| Ex. 4 | $2 \times 10^9$ | −695 | −130 | Normal | None | None |
| Ex. 5 | $3 \times 10^{12}$ | −690 | −130 | Normal | None | None |
| Comp. Ex. 1 | $5 \times 10^5$ | −690 | −140 | Normal | *2 | *3 |
| Comp. Ex. 2 | $9 \times 10^{15}$ | −380 | −80 | Low | *2 | None |
| Comp. Ex. 3 | $4 \times 10^{15}$ | −370 | −75 | Low | *2 | None |

As apparent from the above Tables 1 and 2, since the nylon-6 of Comparative Example 2 and the polyurethane containing no alkali metal salt of Comparative Example 3 had a high volume resistivity, they only provided a low charging ability and nonuniform charging, whereby the resultant images had a low image density and white spots. While the charging member of Comparative Example 1 provided a normal charging potential, it provided a lateral or horizontal streak or white dropout due to a pin-hole. The lateral streak appeared along the contact area between the charging member and the photosensitive member.

On the other hand, each of the charging members of Examples 1–5 provided a good charging ability and did not provide a lateral streak or white dropout due to a pin-hole. Further, even under a low temperature—low humidity condition, these charging members provided little variation in resistivity and provided good images.

Examples 6–10

A charging member was prepared in the following manner.

100 wt. parts of chloroprene rubber and 5 wt. parts of electroconductive carbon were melt-kneaded and molded into a roller shape having a diameter of 20 mm and a length of 230 mm wherein a stainless steel shaft having a diameter of 6 mm and a length of 250 mm was disposed in the center portion, thereby to form a base layer of a roller-form charging member. The volume resistivity of the base layer was $3\times10^4$ ohm.cm when measured at a temperature of 22° C. and a humidity of 60%.

Then, 40 wt. parts of a polycarbonate resin (trade name: Panlite L-1250, manufactured by Teijin Kasei K.K.) was dissolved in a mixture solvent comprising 35 wt. parts of dioxane and 25 wt. parts of dichloromethane, to thereby prepare a coating solution. 10 wt. parts of each of NaSCN, $LiIO_4$, $NaS_2O_3$, $LiO_3SCF_3$ and LiCl was added to the above-mentioned coating solution, respectively, thereby to prepare five species of coating liquids for the surface layer. Each of the thus obtained five species of coating liquids was applied onto the above-mentioned base layer by dip coating and dried at 100° C. for 30 min. to form a surface layer of charging member having a thickness of 80 microns (after drying), whereby five species of charging members were prepared (Examples 6–10). Further, five species of surface layers were respectively formed on an aluminum sheet in the same manner as described above, and their volume resistivities were measured.

Separately, an electrophotographic photosensitive member was prepared in the following manner.

An undercoat layer was formed on a substrate in the same manner as in Example 1.

Then, 20 wt. parts of ϵ-copper phthalocyanine (manufactured by Toyo Ink. K.K.) and 10 wt. parts of a polyvinyl butyral (trade name: S-LEC BL-S, manufactured by Sekisui Kagaku K.K.) were dispersed in 70 wt. parts of methyl ethyl ketone by means of a sand mill. The thus obtained dispersion was applied onto the above-mentioned undercoat layer to form thereon a 0.2 micron-thick charge generation layer.

Then, a charge transport layer was formed on the charge generation layer in the same manner as in Example 1, whereby a photosensitive member (No. 2) was prepared.

The thus prepared photosensitive member No. 2 was assembled in a laser printer using a reversal development system and having a system arrangement as shown in FIG. 2 (trade name: LBP-8, manufactured by Canon K.K.) which had been so modified that each of the above-mentioned primary charging rollers was assembled therein instead of the primary corona charger as shown in FIG. 2.

In such an apparatus, a superposition of a DC voltage of −750 V and an AC voltage having a peak-to-peak voltage of 1500 V was used for the primary charging, whereby a dark part potential, and a light part potential were measured. In addition, a pin hole having a diameter of 1 mm was made in the photosensitive member, and the resultant image was evaluated.

The results are shown in Table 3 appearing hereinafter.

Further, the volume resistivity of each charging member, potential characteristics and resultant images obtained by assembling each charging member in a laser printer using a reversal development system were evaluated in the same manner as described above except that these items were evaluated under a low temperature—low humidity condition (temperature: 15° C.; humidity: 10%). The results are shown in Table 4 appearing hereinafter.

Comparative Example 4

A roller-type member obtained in Example 6 which comprised the stainless steel shaft and the base layer disposed thereon was as such assembled in a laser printer instead of the primary corona charger and evaluations were conducted in the same manner as in Example 6.

The results are shown in Tables 3 and 4 appearing hereinafter.

Comparative Example 5

A base layer for charging member was formed on a stainless steel shaft in the same manner as in Example 6.

Then, a coating liquid obtained by dissolving 10 wt. parts of nylon-6 in 90 wt. parts of dimethylformamide was applied onto the base layer by dip coating to form thereon a surface layer having a thickness of 80 microns (after drying), whereby a charging member was prepared.

The thus obtained charging member was evaluated in the same manner as in Example 6. The results are shown in Tables 3 and 4 appearing hereinafter.

Comparative Example 6

A charging member was prepared in the same manner as in Example 6 except that the alkali metal salt of NaSCN was not added to the coating liquid for surface layer.

The thus obtained charging member was evaluated in the same manner as in Example 6. The results are shown in Tables 3 and 4 appearing hereinafter.

TABLE 3

| Example | Alkali metal salt | Material for surface layer | Volume resistivity of surface layer material (ohm · cm) | Dark part potential (V) | Light part potential (V) | Image density | Image defect | Leak due to pin-hole |
|---|---|---|---|---|---|---|---|---|
| Ex. 6 | NaSCN | Poly-carbonate | $8 \times 10^7$ | −700 | −150 | Normal | None | None |
| 7 | $LiIO_4$ | Poly-carbonate | $9 \times 10^8$ | −680 | −150 | Normal | None | None |
| 8 | $NaS_2O_3$ | Poly-carbonate | $7 \times 10^9$ | −690 | −145 | Normal | None | None |
| 9 | $LiO_3SCF_3$ | Poly-carbonate | $3 \times 10^8$ | −700 | −150 | Normal | None | None |
| 10 | LiCl | Poly-carbonate | $4 \times 10^9$ | −695 | −150 | Normal | None | None |
| Comp. Ex. 4 | — | *4 | $3 \times 10^4$ | −700 | −155 | Normal | *5 | *6 |
| 5 | — | Nylon-6 | $1 \times 10^{13}$ | −430 | −70 | High | *5 | None |
| 6 | — | Poly-carbonate | $6 \times 10^{14}$ | −380 | −70 | High | *5 | None |

*4: Chloroprene containing carbon dispersed therein.
*5: Black spots were observed.
*6: Lateral back strew occurred.

TABLE 4

| Example | Volume resistivity of surface layer material (ohm · cm) | Dark part potential (V) | Light part potential (V) | Image density | Image defect | Leak due to pin-hole |
|---|---|---|---|---|---|---|
| Ex. 6 | $3 \times 10^{10}$ | −700 | −165 | Normal | None | None |
| Ex. 7 | $7 \times 10^{11}$ | −680 | −165 | Normal | None | None |
| Ex. 8 | $4 \times 10^{12}$ | −700 | −160 | Normal | None | None |
| Ex. 9 | $4 \times 10^{10}$ | −705 | −170 | Normal | None | None |
| Ex. 10 | $8 \times 10^{12}$ | −700 | −160 | Normal | None | None |
| Comp. Ex. 4 | $5 \times 10^5$ | −710 | −190 | Normal | *5 | *6 |
| Comp. Ex. 5 | $9 \times 10^{15}$ | −420 | −90 | High | *5 | None |
| Comp. Ex. 6 | $9 \times 10^{15}$ | −400 | −85 | High | *5 | None |

Examples 11–14

Four species of charging members were prepared in the same manner as in Example 1 except that an alkali metal salt and a resin were used in the surface layer according to the combinations as shown in the following Table 5.

The thus obtained charging members were evaluated in the same manner as in Example 1. The results are shown in the following Table 5.

TABLE 5

| Example | Alkali metal salt | Material for surface layer | Volume resistivity of surface layer material (ohm · cm) | Dark part potential (V) | Light part potential (V) | Image density | Image defect | Leak due to pin-hole |
|---|---|---|---|---|---|---|---|---|
| Ex. 11 | LiBr | Nitro-cellulose *7 | $8 \times 10^9$ | −695 | −120 | Normal | None | None |
| 12 | KSCN | Polyvinyl acetate *8 | $4 \times 10^9$ | −700 | −110 | Normal | None | None |
| 13 | $NaBF_4$ | Poly-acrylamide *9 | $2 \times 10^{10}$ | −700 | −115 | Normal | None | None |
| 14 | $LiClO_4$ | Poly-propylene glycol *10 | $7 \times 10^8$ | −690 | −105 | Normal | None | None |

*7: Mn (number-average molecular weight) = $15 \times 10^4$
*8: Mn = $10 \times 10^4$
*9: Mn = $8 \times 10^4$
*10: Mn = $11 \times 10^4$ As apparent from the above-mentioned results, the charging member according to the present invention having a surface layer which comprises a resin containing an alkali metal salt is excellent in charging ability, and is capable of suitably retaining image density and of suppressing an image defect. Further, the charging member according to the present invention may prevent a leak due to a pin-hole thereby to prevent lateral streak or white dropout. Moreover, such a charging member provides excellent charging ability and suitable image density, and prevents an image defect, even under a low temperature—low humidity condition.

As described hereinabove, the charging member according to the present invention provides a stable potential characteristic and little image defect, and reduces a leak due to a pin-hole. Further, the charging member according to the present invention provides stable potential and image formation characteristics even under a low temperature—low humidity condition.

What is claimed is:

1. A device for providing contact charging comprising: an electrophotographic photosensitive member and a charging member, wherein the charging member has an electroconductive substrate and a surface layer thereon for contacting the electrophotographic photosensitive member, wherein the surface layer has a value of volume resistivity higher than that of the electroconductive substrate and comprises:

(a) a resin selected from the group consisting of polyurethane resins and polycarbonate resins, and (b) an alkali metal salt contained therein, and wherein the electroconductive substrate is electrically connected to an external power supply and transfers a charge to an outer surface of said surface layer for contact charging the electrophotographic photosensitive member.

2. A device according to claim 1, wherein the surface layer comprises 100 parts by weight of the resin and 0.5–40 parts by weight of the alkali metal salt.

3. A device according to claim 1, wherein the alkali metal salt comprises at least one compound selected from the group consisting of: salts of lithium, sodium and potassium with $ClO_4$, SCN, $BF_4$, $NO_3$, $CO_3$, $CS_3$, $WO_4$, $BO_2$, $IO_4$, $SO_4$, $S_2O_3$, $PO_3$, $MoO_4$, $O_3SCH_3$, $O_3SCF_3$, $SiF_6$ and halogen atoms.

4. A device according to claim 3, wherein the alkali metal salt comprises at least one compound selected from the group consisting of: $LiClO_4$, $LiSCN{\cdot}2H_2O$, KSCN, $LiBF_4$, $NaNO_3$, $Na_2CO_3{\cdot}7H_2O$, $K_2WO_4$, $K_2CS_3$, $NaBO_2$, $LiIO_4$, $LiSO_4$, $NaS_2O_3{\cdot}5H_2O$, $KPO_3$, $Na_2MoO_4$, $LiO_3SCH_3$, $LiO_3SCF_3$, $K_2SiF_6$, LiCl, LiBr, NaBr, LiI, $NaI{\cdot}2H_2O$, and KI.

5. A device according to claim 1, wherein the surface layer has a thickness of 5–500 microns.

6. A device according to claim 1, wherein a base layer is disposed between the substrate and the surface layer.

7. A device according to claim 6, wherein the surface layer has a volume resistivity of $10^6$ to $10^{12}$ ohm.cm, and the volume resistivity of the surface layer is larger than that of the base layer contacting the surface layer.

8. A device according to claim 6, wherein the base layer has a volume resistivity which is higher than that of the substrate and lower than that of the surface layer.

* * * * *